United States Patent [19]

Bell

[11] Patent Number: 4,615,270

[45] Date of Patent: Oct. 7, 1986

[54] PRINTED SHEET URETHANE PROPELLANT

[75] Inventor: Frank H. Bell, Logan, Utah

[73] Assignee: Morton Thiokol, Inc., Chicago, Ill.

[21] Appl. No.: 724,433

[22] Filed: Mar. 18, 1985

[51] Int. Cl.[4] ..... C06D 5/06

[52] U.S. Cl. ..... 102/289; 102/291; 264/3.2

[58] Field of Search ..... 102/287, 288, 289, 291; 264/3 A, 3 B, 3.1, 3.2, 3.3

[56] References Cited

U.S. PATENT DOCUMENTS

| | | | |
|---|---|---|---|
| 273,209 | 2/1883 | Wiard | 102/27 |
| 552,919 | 1/1896 | Maxim | 102/290 X |
| 677,528 | 7/1901 | Maxim | 102/288 |
| 930,979 | 8/1909 | Maxim | 102/292 |
| 3,067,686 | 12/1962 | Coover, Jr. et al. | 102/98 |
| 3,354,010 | 11/1967 | Hopper et al. | 264/3 A |
| 3,367,268 | 2/1968 | Spenadel | 102/289 |
| 3,812,785 | 5/1974 | Cohen et al. | 102/291 |
| 4,013,743 | 3/1977 | Blasche, Jr. et al. | 102/289 X |
| 4,408,534 | 10/1983 | Araki et al. | 102/288 |

*Primary Examiner*—Peter A. Nelson

*Attorney, Agent, or Firm*—James C. Simmons; Gerald K. White

[57] ABSTRACT

A roll calendered sheet propellant features thin sheets of solid propellant which have been consolidated by the calendering operation. After calendering, the sheet propellant is roll-printed or "coined" with a pattern, which forms propellant flakes after ignition in a gun/-cannon system. The printed pattern consists of a designed flake geometry, for example, of contiguous diamond or square shapes providing flame communicating paths therebetween. The formation of propellant flakes depends upon a characteristic of propellants, specifically that they burn faster in zones of high residual stress. By varying the design of the roll printer, the printed pattern, in a two-sided printed sheet configuration, may include a cut in the pattern of the order of 15 to 40% of the propellant sheet uncut web depth. After roll printing, the propellant may be cut to length and rolled for insertion into a shell or cartridge case.

12 Claims, 4 Drawing Figures

PRINTED SHEET URETHANE PROPELLANT

BACKGROUND OF THE INVENTION

1. Field of the Invention

This invention relates to an improvement in explosives, and more particularly, to an improved propellant charge that is capable of generating a large volume of gas in a short time and having especial utility in gun and cannon shells or cartridges.

2. Description of the Prior Art

Explosives used to propel projectiles from guns and cannons do not detonate. Termed propellants, they consist of uniform flakes, spheres, or hollow grains which burn with the production of gas. Gas is produced at a controlled rate, under a pressure of about 3500 kg./sq. cm. (50,000 lbs./sq. in.), while the projectile is being accelerated. The time available for gas generation is very short, being a hundredth of a second or less depending upon the velocity of the projectile and the length of the gun barrel.

Modern gun/cannon propellant is a smokeless-powder consisting essentially of nitrocellulose mixed with ethyl ether and ethyl alcohol to form a stiff dough. The practice has been to extrude the dough through dies, cut it into grains of desired length, and to dry it. Nitrocellulose is the major ingredient in single-base powder. In double-base powder, nitroglycerin, in an amount of about 7–68%, is provided in addition to the nitrocellulose.

Shells or cartridges have fixed shapes and volumes that are determined by the weapons in which they are used. Adjustment in the projectile propelling thrust must, therefore, be effected by variation in the form and formulation of the propellant that is used. Maximum mass loading of propellant per unit of available shell volume is the criterion to be met for best or proper performance.

Filling the shell with a single solid propellant grain would appear most efficiently to meet this objective. Such loading presents a problem, however, because the surface area of the propellant that is exposed to the flame upon ignition is limited and precludes good flame spreading and a sufficiently rapid generation of gas for proper propulsion of the projectile.

Most modern gun/cannon propellants take the form of long rods (Cordite), short rods (IMR powders), or flakes (Ballistite). (IMR powders are those documented in the Interim Memorandum Report of the Ballistic Research Laboratory at Aberdeen, Md.) These shapes are provided in order to enhance flame spreading, and hence, to heighten the rate of gas generation upon ignition of the propellant. The processing of these shapes, however, is costly. Additionally, maximum mass volume loading of the propellant is not achieved because of the air space between the rods and the flakes as incorporated in a shell.

It has been proposed in the prior art to provide a smokeless-powder cartridge wherein the smokeless-powder is ignited simultaneously at all points. Thus, as disclosed in U.S. Pat. No. 838,748 dated Dec. 18, 1906, and granted to Francis I. du Pont, there is provided a smokeless-powder charge in the form of a sheet and a priming charge of quick-burning material, also in the form of a sheet, superimposed one on the other and coiled within a cartridge. It is evident that such an arrangement fails to achieve maximum mass loading of the smokeless-powder, irrespective of how tightly coiled, because of the volume occupied by the priming charge of quick-burning material.

In U.S. Pat. No. 552,919, dated Jan. 14, 1896, and granted to Hudson Maxim, there is disclosed a cellular explosive charge comprising a continuous sheet of an explosive colloidal nitro compound having a multiplicity of interior widely separated non-communicating cavities. The sheet is rolled into a cylindrical form. The cavities are produced in the sheet in a number of different ways, as by forcing air into the sheet while it is in a plastic condition, placing hollow capsules or bits of sponge in the mass while viscid, and by drawing the sheet between rolls one of which is smooth and the other having projections that punch spaced rectangular depressions in one side of the sheet. When the sheet is rolled up, the depressions form spaced cavities in the resulting cylinder.

When ignited, the Maxim cylinder is said to continually break up as it is being consumed thereby to present additional surfaces to the flame for increasing the rate of consumption and causing an accelerating pressure upon the projectile. Since the cavities in each case are widely separated, the breakup during burning is unpredictable and the contribution made thereby to improving the flame spread leaves something to be desired.

In the Maxim patent, it is contemplated that granular powder may be used to fill the depressions that are punched in one side of the sheet. While this may improve the loading, it does so with a material that is less effective for the generation of gas, namely the granular material. Moreover, there is no disclosure as to how this operation would be carried out. It would appear to comprise a manual procedure that is labor intensive and costly.

There is thus a need and a demand for further improvement in propellants and particularly in their physical configuration and formulation for use in guns and cannons.

SUMMARY OF THE INVENTION

An object of the invention is to provide an improved form of roll calendered sheet propellant charge that is capable of generating a large volume of gas in a short time and having especial utility in gun and cannon shells or cartridges.

Another object of the invention is to provide a less expensive means of making a flake type gun propellant.

Still another object of the invention is to provide a two-sided geometry for coining a propellant sheet having the advantageous effect of giving the coined pattern a symmetrical stress field in the propellant sheet whereby, when ignited, the flame front is effective to cut flakes from the parent propellant sheet, such flakes then being free to move down the gun tube in a typical manner.

A specific object of the invention is to provide for use in the preparation of such a two-sided coined propellant sheet an HMX/urethane thermoplastic formulation.

In accomplishing these and other objectives of the invention, a gun/cannon formulation is selected with mechanical properties which permit a roll-calendering operation for the formation of sheet propellant. After sheets have been prepared, but before curing (set-up) and before cooling, the sheets are passed between a pair of coining rolls such that a flake geometry, for example, a diamond or square pattern, is pressed into both sides of the moving sheet in a uniform and repeating manner.

The shape of the "flakes" may be determined by a series of ballistic surface regression calculations which are common to the art.

The purpose of the coining operation is to weaken the propellant sheet in a symmetrical manner so that upon ignition, the flame front cuts flakes free from the parent propellant sheet. Such flakes are then free to move down the gun tube in a typical manner.

Propellants burn faster in zones of high stress. Thus, the ballistic event in a gun or cannon can be used to create the final form required for a propellant in order to obtain proper performance. Thus, in accordance with the present invention, the weapon, that is, the gun or cannon, is used to convert the propellant sheet into flakes. Flakes are a common, quick burning, propellant configuration.

The roll-printed (coined) pattern on each of the opposite sides of the propellant sheet may have a depth of between 15 and 40% of the uncoined propellant web. This will guarantee that significant residual stresses are left in the propellant matrix and yet will permit safe handling for loading operations. If the roll-printed pattern is provided on one side only of the propellant sheet, the printed pattern may include a cut on the order of 30 to 80 percent of the propellant web uncut depth.

An added advantage of the propellant according to the present invention is that the sheets may be tightly coiled for efficient use of space in a cartridge case, thereby providing maximum mass loading per unit of available volume.

The various features of novelty which characterize the invention are pointed out with particularity in the claims annexed to and forming a part of this specification. For a better understanding of the invention, its operating advantages, and specific objects attained by its uses, reference is made to the accompanying drawings and descriptive matter in which a preferred embodiment of the invention is illustrated.

DESCRIPTION OF THE PREFERRED EMBODIMENT

Figure 1:
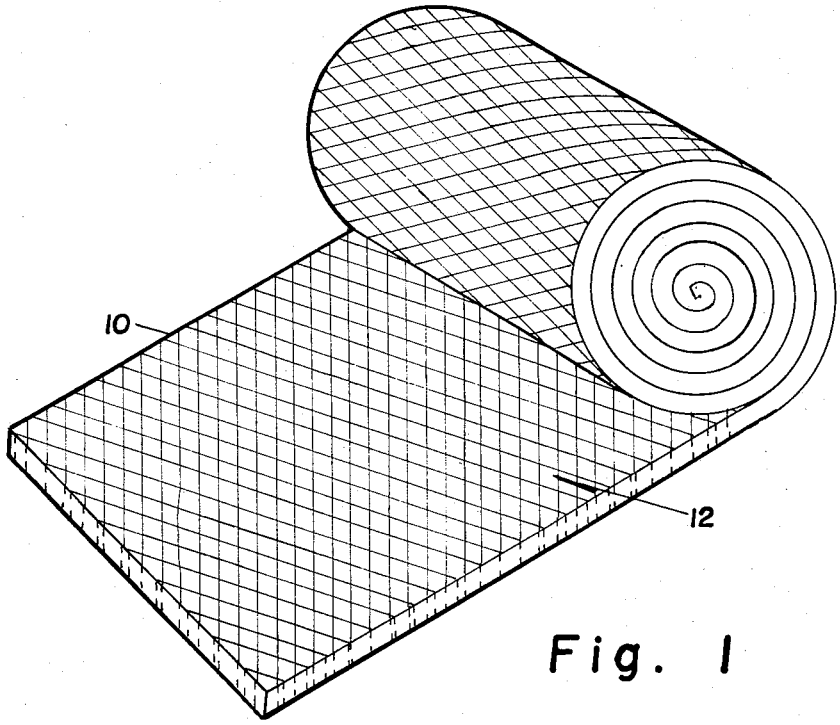
FIG. 1 is a perspective view showing a sheet of the HMX/urethane propellant according to the invention with the flakes printed on the opposite sides thereof and the manner in which the sheet may be coiled in compact form for ready insertion into a cartridge or shell.
Figure 4:
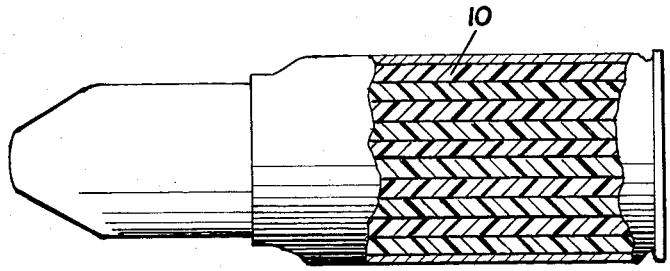
FIG. 4 is a side elevation, partly in section, of a shell embodying the invention.

In FIG. 1 the numeral 10 represents a sheet of HMX/urethane propellant the formulation of which is described in detail hereinafter. The sheet 10 is adapted to be tightly rolled or coiled in spiral form, as indicated in the drawing, and inserted into a cartridge or shell.

The sheet 10 features thin sheets of solid propellant which are consolidated by a calendering operation. After calendering, the propellant sheet 10 is roll-printed or coined with a uniform and repeating pattern, indicated at 12. The illustrated printed pattern 12 consists of a designed diamond-shaped propellant flake geometry that is pressed in on both sides of the propellant sheet 10. This geometry establishes a symmetrical stress field in the sheet 10. Since propellants burn faster in zones of high residual stress, the ballistic event in the gun or cannon can be used, as described, to create the final form that a propellant needs for proper performance.

Figure 2:
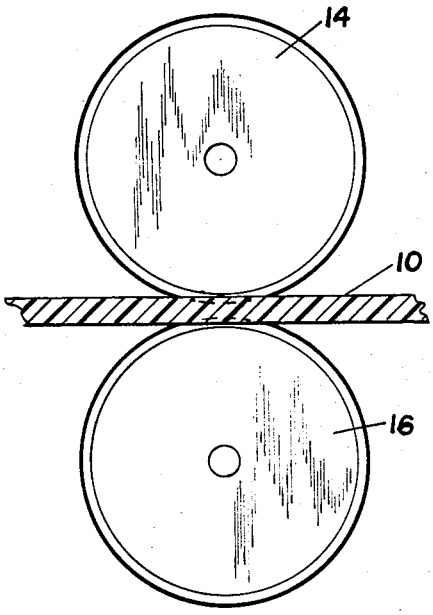
FIG. 2 is a schematic illustration of a coining roll arrangement by means of which the flakes may be symmetrically printed on the opposite sides of the sheet.
Figure 3:
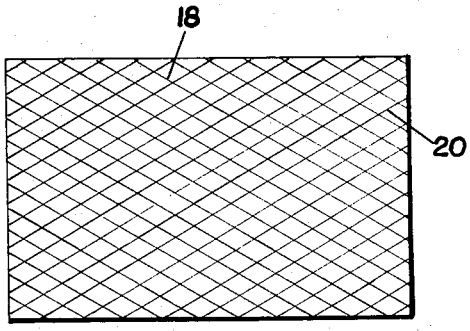
FIG. 3 is a developed view of a portion of the surface of the coining rolls of FIG. 2.

The manner in which the propellant sheet 10 is roll-printed or coined is shown in FIG. 2. As there shown, the propellant sheet 10 is passed between a roll-printer comprising a pair of rolls 14 and 16 which preferably are identical, each being provided with a plurality of criss crossing continuous projecting knife edges, edges 18 running a first direction and edges 20 running in a second direction. The edges 18 and 20 collectively form the diamond-shaped pattern 12 on the opposed sides of the propellant sheet 10. As those skilled in the art will understand, by varying the design on the roll-printer rolls 14 and 16, the printed pattern may comprise another design, for example, a square shape. Irrespective of the shape of the design, each may include a cut in the pattern on the order of 15 to 40 percent of the propellant un-cut web depth. After roll-printing, the propellant may be cut to length and rolled for insertion into a shell or cartridge case. Where printing is effected on one side only of the sheet 10, the cut in the pattern preferably is of the order of 30 to 80% of the uncut web depth.

The ballistic properties of a suggested formulation, according to the present invention, of an HMX/urethane thermoplastic is, as follows:

| | HMX/Urethane Thermoplastic Pc = 1,000 psia Polymer = PC-58, or equal | | | | | |
|---|---|---|---|---|---|---|
| % HMX | 65 | 70 | 75 | 80 | 85 | 90 |
| A.G.M.W. | 19.2 | 19.3 | 20.0 | 20.8 | 21.6 | 22.5 |
| Tv, °K. | 1,677 | 1,988 | 2.352 | 2,711 | 2,063 | 3,390 |
| IMP | 242,400 | 286,200 | 327,100 | 362,900 | 394,000 | 419,000 |
| VIMP | 21,700,000 | 26,560,000 | 31,600,000 | 36,310,000 | 41,030,000 | 45,460,000 |

A.G.M.W. = Average Gas Molecular Weight
Tv = Constant Volume Flame Temperature, in degrees Kelvin
IMP = Mass Impetus, $\frac{\text{ft-lbf}}{\text{lbm}}$
VIMP = Volumetric Impetus, $\frac{\text{ft-lbf}}{\text{ft}^3}$ Selected Polymer
Name: PC-58
Source: K. J. Quinn & Co.
Calender: Temperature (Min.): 123° C.
Hardness: Shore A 80
Polymer Type: Thermoplastic Urethane It will be understood that the present invention is not limited in its use to HMX. Any high melting crystalline high explosive in a low melting urethane thermoplastic matrix may be employed. For example, RDX or NQ can be substituted for HMX. If desired, several crystalline explosives may be used together.

The sheet propellant embodying the foregoing formulations may be surface inhibited by spraying, dipping or roll coating. A typical inhibitor material is DNT (dinitrotoluene).

Formulation of this propellant may be very simple since it may comprise as few as two components. A stabilizer such as 2-NDPA or Centralite is not required.

The sheet propellant of the present invention is a "LOVA" class propellant of low relative hazard.

Thus, in accordance with the present invention, there is provided an improved form of roll calendered sheet propellant for use in gun and cannon shells or cartridges which is characterized in being responsive to the ballistic event in the weapon for conversion into the final form required for proper performance, specifically conversion into flakes, a common quick burning configuration, that are free to move down the gun tube in a typical manner. The selected propellant formulation is roll-calendered for the formation of sheet propellant. Before curing and cooling, the sheets are subjected to a printing or coining operation for pressing a flake geometry of a diamond or other communicating pattern into both sides of the sheet. This pattern pressed into the opposed surfaces of the propellant establishes a symmetrical stress pattern therein such that, upon ignition, and as it is being consumed, the parent propellant sheet continually breaks up with micro-cracks exposing additional surfaces or areas to the flame as well as the flame moving along the communicating lines of the diamond or square shaped pattern. Thus, the flame front cuts flakes free from the parent sheet, which flakes are free to move down into the gun tube.

The printed propellant sheet may be tightly coiled and placed in a shell or cartridge. Since the volume displaced by the lines cut in the sheet propellant by the pattern cut therein is very small, the propellant sheet of the present invention is further characterized in providing a maximum mass loading per unit of available volume, thus satisfying the important criterion mentioned hereinbefore for proper propellant performance.

The printed propellant sheet is still further characterized in that the flake propellant for use in guns and cannons is produced in a much less costly fashion and with less processing than is presently required in the production of flake propellant for such use.

What is claimed is:

1. A propellant charge comprises a coiled sheet of solid propellant and means including a quantity of interconnecting score lines in at least one surface thereof for providing a uniform and repeating pattern of contiguous geometrically shaped propellant portions in said sheet.

2. A propellant charge as defined in claim 1 wherein said pattern means includes a quantity of said score lines in the surfaces of both sides of said propellant sheet.

3. A propellant charge as defined in claim 2 wherein said propellant portions are diamond shaped.

4. A propellant charge as defined in claim 1 wherein said score lines have a depth which is equal to about 30 to 80 percent of the propellant sheet un-cut depth.

5. A propellant charge as defined in claim 2 wherein said score lines have a depth on each side of said propellant sheet which is equal to about 15 to 40 percent of the propellant sheet un-cut depth.

6. A propellant charge as defined in claim 5 wherein said propellant portions are diamond shaped.

7. A propellant charge as defined in claim 6 further including a shell, said coiled sheet of solid propellant being inserted in said shell.

8. A propellant charge as defined by claim 6 wherein said sheet of propellant comprises HMX/Urethane Thermoplastic.

9. A propellant charge comprises a coiled sheet of solid propellant which has been formed by a calendering operation, means including a quantity of interconnecting score lines in at least one surface of said propellant sheet for providing in said propellant sheet communicating zones of high residual stress whereby propellant portions may be separated from the propellant sheet during combustion to increase combustion speed of the propellant sheet.

10. A propellant charge as defined in claim 9 wherein said residual stress means includes a quantity of score lines in the surface of both sides of said propellant sheet providing a pattern of uniform and repeating geometrically shaped propellant portions on each of the sides of said propellant sheet, said patterns being substantially exactly opposite each other.

11. A propellant charge as defined in claim 10 wherein said propellant portions are diamond shaped.

12. A propellant charge as defined in claim 11 wherein said sheet of propellant comprises a HMX/Urethane Thermoplastic.

* * * * *